US010914182B2

(12) United States Patent
Bae

(10) Patent No.: US 10,914,182 B2
(45) Date of Patent: Feb. 9, 2021

(54) GAS TURBINE

(71) Applicant: DOOSAN HEAVY INDUSTRIES & CONSTRUCTION CO., LTD., Changwon-si (KR)

(72) Inventor: Jin Ho Bae, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 182 days.

(21) Appl. No.: 16/151,324

(22) Filed: Oct. 3, 2018

(65) Prior Publication Data

US 2019/0128128 A1 May 2, 2019

(30) Foreign Application Priority Data

Oct. 30, 2017 (KR) ..... 10-2017-0142151

(51) Int. Cl.
*F01D 5/28* (2006.01)
*F01D 5/02* (2006.01)
*F01D 5/14* (2006.01)

(52) U.S. Cl.
CPC ..... *F01D 5/288* (2013.01); *F01D 5/027* (2013.01); *F01D 5/141* (2013.01); *F05D 2230/90* (2013.01); *F05D 2300/611* (2013.01)

(58) Field of Classification Search
CPC . F01D 5/288; F01D 5/027; F01D 5/20; F01D 5/141; F01D 25/04; F01D 25/06; F05D 2230/90; F05D 2300/611
See application file for complete search history.

(56) References Cited

U.S. PATENT DOCUMENTS 4,682,935 A * 7/1987 Martin ..... F01D 5/141 415/181
8,172,520 B2 * 5/2012 Arrieta ..... F01D 5/18 415/177
9,587,645 B2 * 3/2017 Guglielmin ..... C23C 4/01
10,465,524 B2 * 11/2019 Kimura ..... F01D 5/187
2012/0082556 A1 * 4/2012 Macchia ..... F01D 9/041 416/241 A
2012/0257983 A1 * 10/2012 Williams ..... B29D 99/0025 416/230

FOREIGN PATENT DOCUMENTS

JP H07-180502 A 7/1995
JP 2000-018003 A 1/2000

OTHER PUBLICATIONS

A Korean Office Action dated Jan. 8, 2019 in connection with Korean Patent Application No. 10-2017-0142151 which corresponds to the above-referenced U.S. application (English translation attached).

* cited by examiner

*Primary Examiner* — Richard A Edgar
(74) *Attorney, Agent, or Firm* — Invenstone Patent, LLC

(57) ABSTRACT

Disclosed is a gas turbine including a housing, a rotor rotatably provided in the housing to transfer a rotary force to a compressor, the compressor receiving the rotary force from the rotor and compressing air, a combustor mixing a fuel with the compressed air supplied from the compressor and igniting the mixture of the fuel and the air to generate combustion gas, and a turbine receiving the rotary force caused by the combustion gas generated by the combustor and rotating the rotor by using the received rotary force.

9 Claims, 5 Drawing Sheets

【FIG. 1】
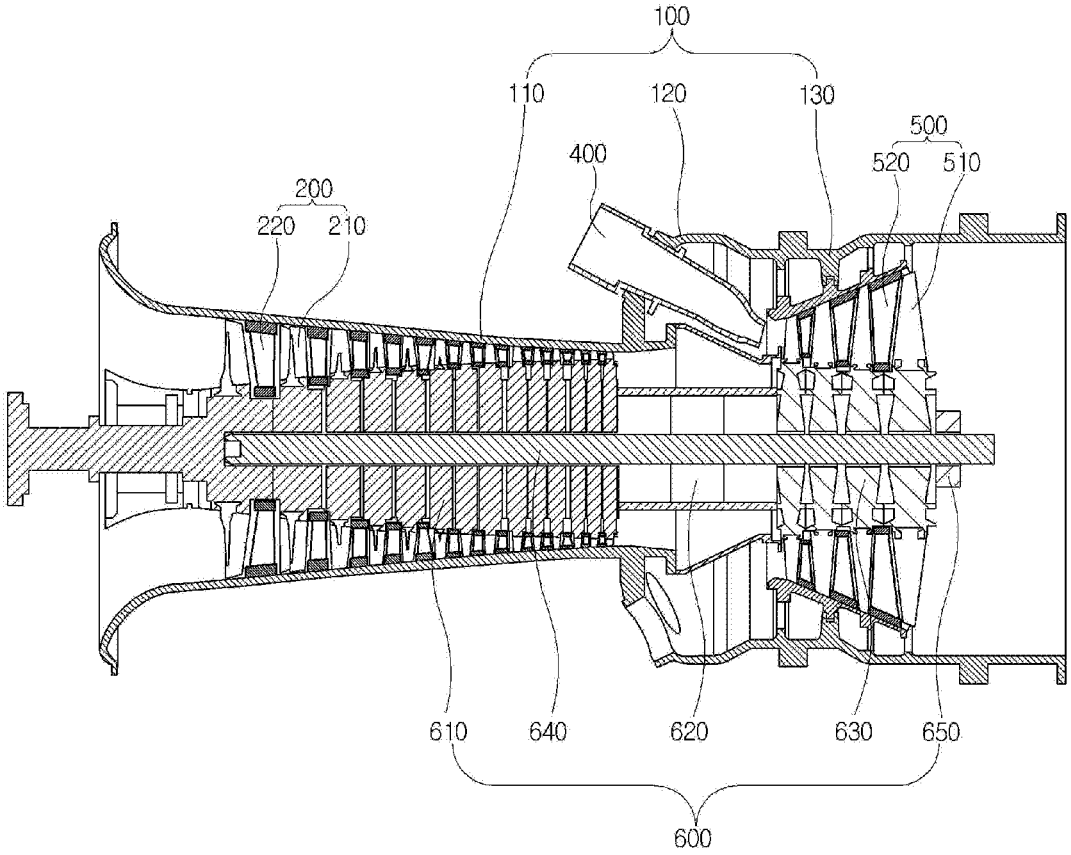

【FIG. 2】
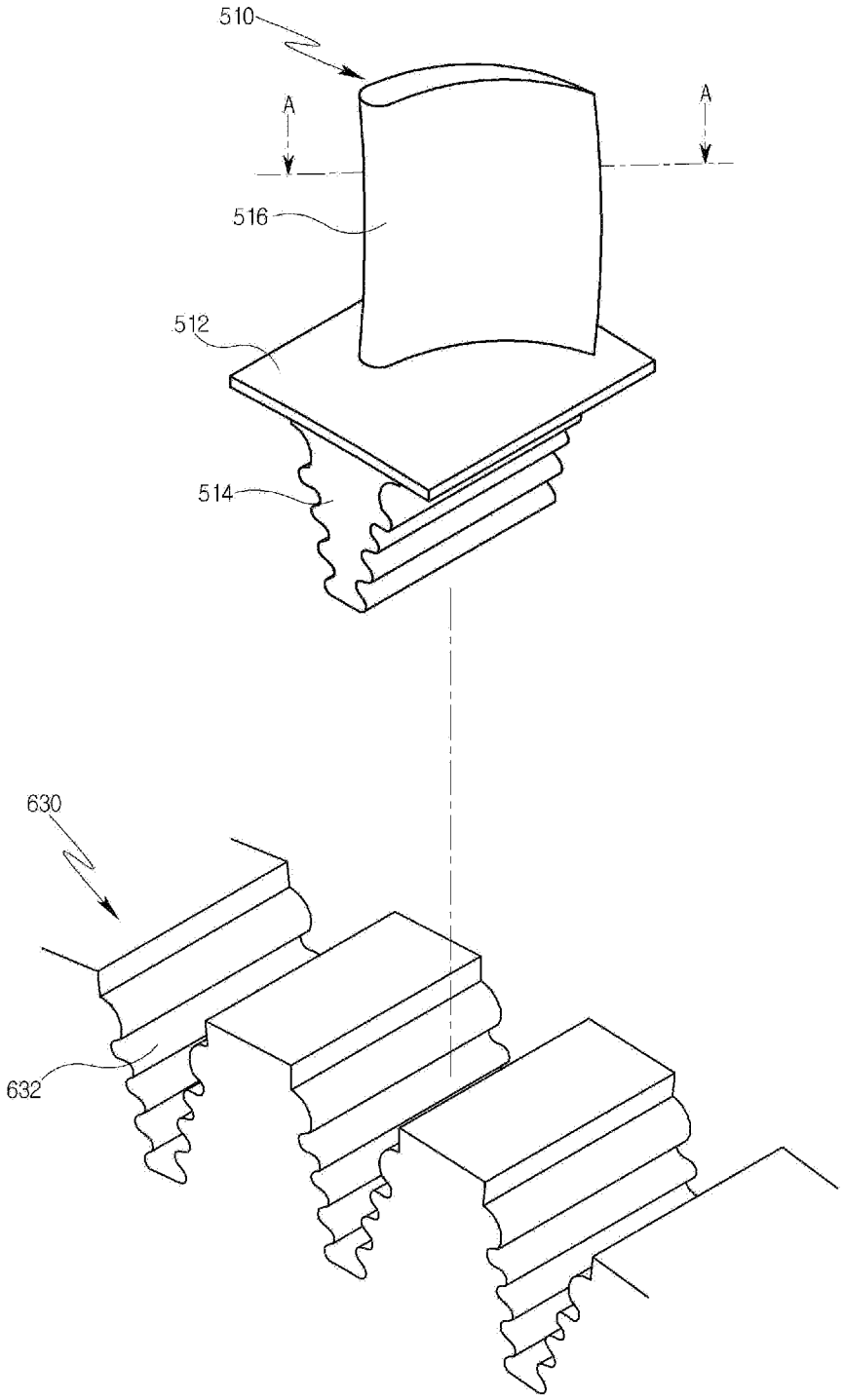

【FIG. 3】
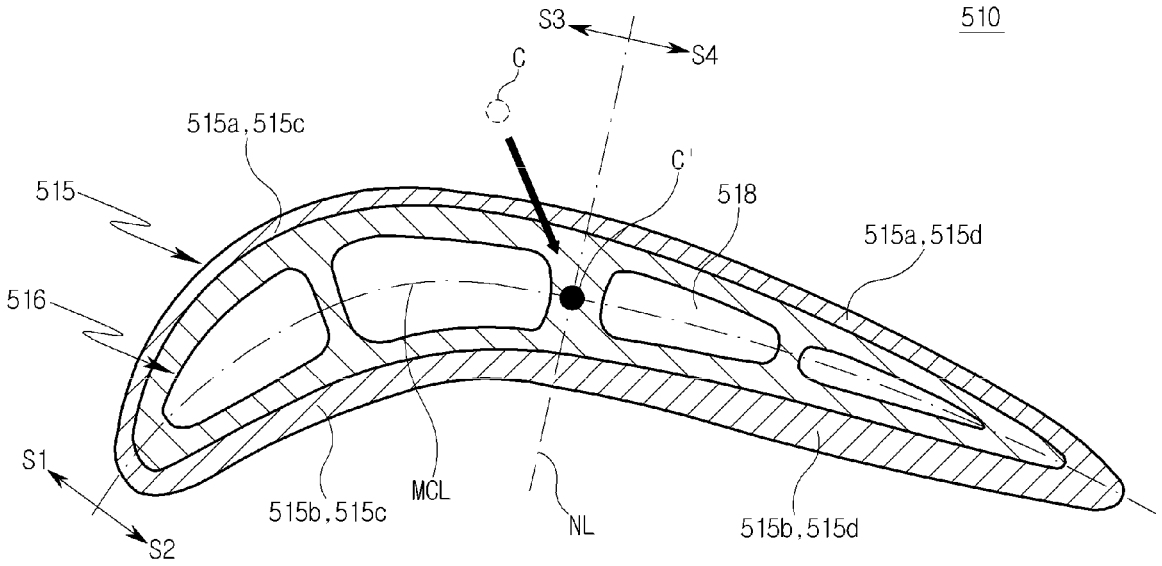

【FIG. 4】
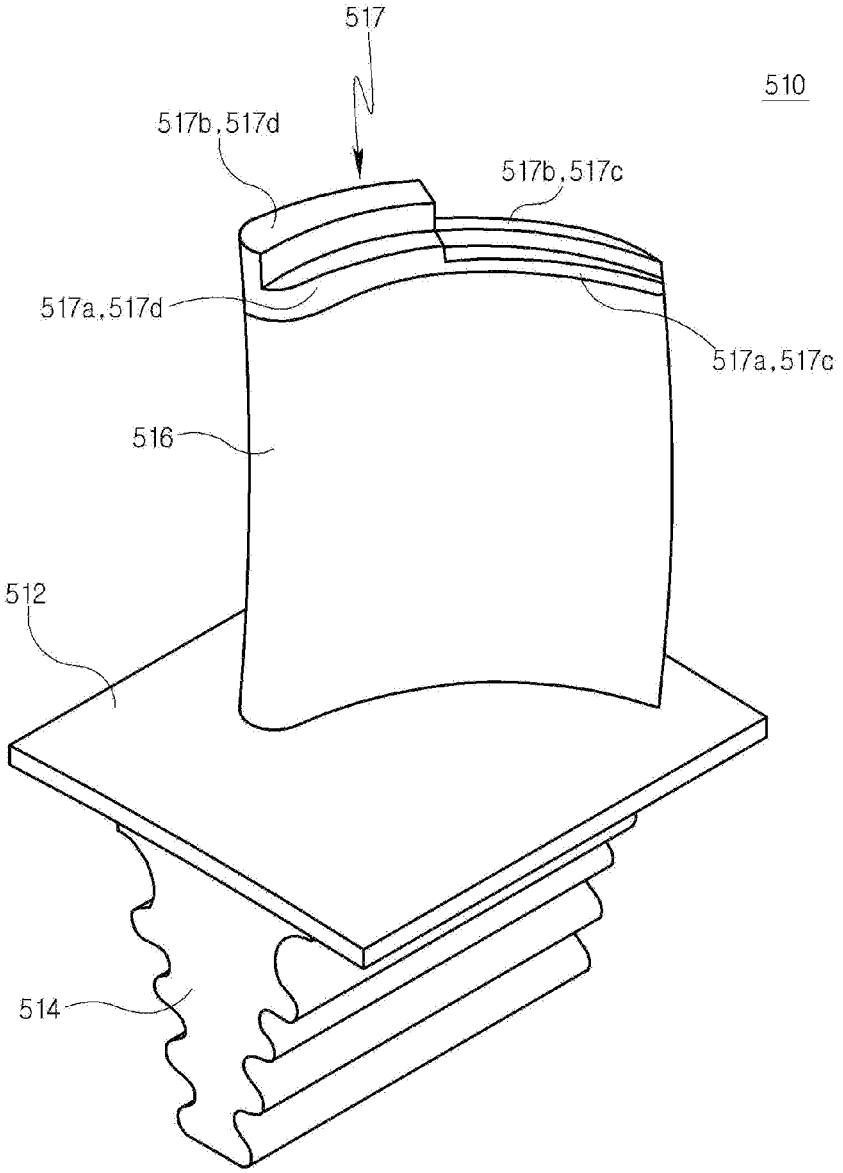

【FIG. 5】
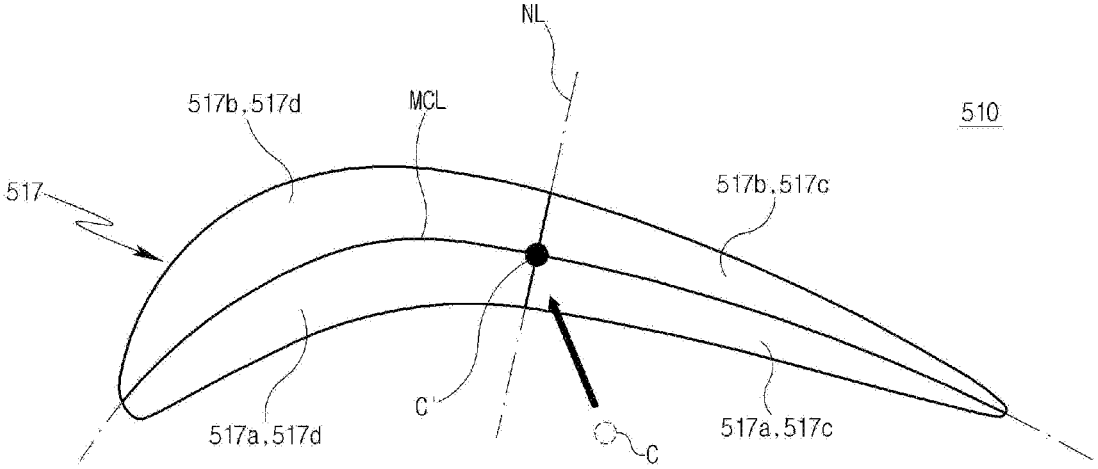

GAS TURBINE

CROSS REFERENCE TO RELATED APPLICATIONS

The present application claims priority to Korean Patent Application No. 10-2017-0142151, filed Oct. 30, 2017. The disclosure of the above-listed application is hereby incorporated by reference herein in their entirety.

FIELD

The present disclosure relates to a gas turbine.

BACKGROUND

The statements in this section merely provide background information related to the present disclosure and do not constitute prior art.

Generally, a turbine refers to a rotary mechanical device that extracts energy from a fluid, such as water, gas, or vapor, and transforms the extracted energy into useful mechanical work. A turbine also means a turbo-machine with at least one moving part, called a rotor assembly, which is a shaft with blades or vanes attached. A fluid is ejected to impact the blades or vanes or to cause reaction force of the blades or vanes, thereby rotating the rotor assembly at high speed.

Turbines are categorized into hydraulic turbines using potential energy of water falling from a high position, steam turbines using thermal energy of vapor, air turbines using pressure energy of high-pressure compressed air, and gas turbines using energy of high-pressure hot gas.

Among them, a gas turbine includes a compressor, a combustor, and a rotor.

The compressor includes a plurality of compressor vanes and a plurality of compressor blades alternately arranged.

The combustor supplies fuel to the compressed air produced by the compressor and ignites the fuel-air mixture with a burner to produce a high-pressure hot combustion gas.

The turbine includes a plurality of turbine vanes and a plurality of turbine blades alternately arranged.

The rotor is installed to pass through the centers of the compressor, the combustor, and the turbine. Both ends of the rotor are rotatably supported by bearings, and one of the two ends of the rotor is connected to a drive shaft of an electric generator.

The rotor includes a plurality of compressor rotor disks to which the compressor blades are retained, a plurality of turbine rotor disks to which the turbine blades are retained, and a torque tube transmitting a rotary force from the turbine rotor disks to the compressor rotor disks.

In the gas turbine structured as described above, the air compressed by the compressor is mixed with fuel and then combusted in a combustion chamber of the combustor, resulting in production of a hot combustion gas which is blown to the turbine.

The combustion gas passes through turbine blade passages to generate torque which in turn rotates the rotor.

Such a gas turbine does not include a reciprocating mechanism such as a piston which is usually provided in a typical four-stroke engine. Therefore, it has no mutual frictional part such as a piston-cylinder part, thereby consuming an extremely small amount of lubricating oil and having a significantly reduced operational amplitude unlike the reciprocating mechanism which features a large operational amplitude. Thus, a gas turbine has an advantage of high speed operation.

However, such a known gas turbine has a drawback that, in case where the center of gravity of an airfoil member of a turbine blade is shifted from a designed position, the gas turbine exhibits abnormal operational behaviors.

SUMMARY

Accordingly, the present disclosure has been made in view of the problems occurring in the related art and is thus intended to provide a gas turbine structured to guarantee that the center of gravity of an air foil member of a turbine blade is located at a designed position so that the gas turbine is free of abnormal operational behaviors.

In order to accomplish the object of the present disclosure, a gas turbine including a housing, a rotor rotatably provided in the housing and configured to transfer a rotary force to a compressor, the compressor receiving the rotary force from the rotor and compressing air using the rotary force, a combustor mixing a fuel with the compressed air supplied from the compressor and igniting the mixture of the fuel and the air to generate combustion gas, and a turbine receiving the rotary force caused by the combustion gas generated by the combustor and rotating the rotor by using the received rotary force. Herein, the turbine includes turbine blades rotating along with rotation of the rotor. Each of the turbine blades includes a turbine blade airfoil member that comes into contact with the combustion gas. The turbine blade airfoil member is formed such that a pre-alignment center of gravity or a post-alignment center of gravity of the turbine blade airfoil member is located within the turbine blade airfoil member in terms of a direction of rotation of the turbine blade airfoil member.

In order to accomplish the object of the present disclosure, a gas turbine comprising: a housing; a rotor rotatably provided in the housing; and a blade configured to rotate along with rotation of the rotor. Herein an airfoil member of the blade includes a coating layer formed on a surface of the airfoil member of the blade, and the coating layer locally differs in either one or both of a thickness and a density.

In order to accomplish the object of the present disclosure, a gas turbine comprising: a housing; a rotor rotatably provided in the housing; and a blade configured to rotate along with rotation of the rotor. Herein an airfoil member of the blade includes a tip wall formed at a tip of the airfoil member, and the tip wall locally differs in either one or both of a height and a density

BRIEF DESCRIPTION OF THE DRAWINGS

FIG. 1 is a cross-sectional view illustrating a gas turbine according to one embodiment of the present disclosure;

FIG. 2 is an exploded perspective view of a turbine blade of the gas turbine of FIG. 1;

FIG. 3 is a cross-sectional view taken along a line A-A of FIG. 2;

FIG. 4 is a perspective view of a turbine blade of a gas turbine according to another embodiment of the present disclosure; and FIG. 5 is a plan view of FIG. 4.

DETAILED DESCRIPTION

Reference will now be made in greater detail to specific embodiments of the disclosure, wherein the specific embodiments may be modified in a variety of other forms. However, it should be understood that the present disclosure is not limited to the specific embodiments, but encompasses all of modifications, equivalents, and substitutes which are included in the spirit and technical scope of the claimed invention.

The terminology used herein is for the purpose of describing particular embodiments only and is not intended to limit the claimed invention. As used herein, the singular forms "a", "an", and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Exemplary embodiments of the present disclosure provide a gas turbine including a housing, a rotor rotatably provided in the housing, and a blade rotating along with rotation of the rotor, in which the blade includes an airfoil member, a coating layer formed on a surface of the airfoil member, and a tip wall formed at a tip of the airfoil member, in which at least among a thickness of the coating layer, a density of the coating layer, a height of the tip wall, and a density of the tip wall may locally vary.

Herein below, a gas turbine according to exemplary embodiments of the present disclosure will be described in detail with reference to the accompanying drawings.

FIG. 1 is a cross-sectional view illustrating a gas turbine according to one embodiment of the present disclosure, FIG. 2 is an exploded perspective view of a turbine blade provided in the gas turbine of FIG. 1, and FIG. 3 is a cross-sectional view taken along a line A-A of FIG. 2.

Referring to FIGS. 1 to 3, according to one embodiment of the present disclosure, a gas turbine includes a housing 100, a rotor 600 rotatably provided in the housing 100, a compressor 200 receiving a rotary force from the rotor 600 and compressing air introduced into the housing 100 using the rotary force to produce compressed air, a combustor 400 mixing fuel with the compressed air produced by the compressor 200 and igniting the fuel-air mixture to produce a combustion gas, a turbine 500 rotating the rotor 600 with a rotary force caused by the combustion gas produced by the combustor 400, an electric generator interlocked with the rotor 600 for generation of electricity, and a diffuser discharging the combustion gas passing through the turbine 500.

The housing 100 includes a compressor housing 110 for accommodating the compressor 200, a combustor housing 120 for accommodating the combustor 400, and a turbine housing 130 for accommodating the turbine 500.

The compressor housing 110, the combustor housing 120, and the turbine housing 130 are arranged upstream or downstream in this order in terms of a fluid flow.

The rotor 600 includes a compressor rotor disk 610 accommodated in the compressor housing 110, a turbine rotor disk 630 accommodated in the turbine housing 130, and a torque tube 620 accommodated in the combustion housing 120 and installed to connect the rotor disk 610 and the turbine rotor disk 630, and a tie rod 640 and a nut 650 for fastening the compressor rotor disk 610, the torque tube 620, and the turbine rotor disk 630.

There is multiple rotor disks 610 which are arranged in an axial direction of the rotor 600. The compressor rotor disks 610 is arranged in multiple stages.

Each of the compressor rotor disks 610 has a disk shape, and the outer circumferential surface of each compressor rotor disk 610 is provided with multiple compressor blade coupling slots to be engaged with respective compressor blades 210 which will be described later.

The compressor blade coupling slots have a fir-tree shape to firmly retain the respective compressor blades 210 so that the compressor blades 210 will not fly out of the compressor blade coupling slots in a direction of rotation of the rotor 600.

The compressor blades 210 are typically coupled to the compressor rotor disk 610 in a tangential manner or an axial manner. In the present embodiment, the compressor blades 210 are configured to be coupled to the compressor rotor disk 610 in an axial manner. According to the present embodiment, each compressor rotor disk has multiple compressor blade coupling slots, and the compressor blade coupling slots are radially arranged along the circumferential direction of the compressor rotor disk 610.

The turbine rotor disk 630 has the substantially same shape as the compressor rotor disk 610. There are multiple turbine rotor disks 630 which are arranged in the axial direction of the rotor 600. The turbine rotor disks 630 are arranged in multiple stages.

Each of the turbine rotor disks 630 has a disk shape, and the outer circumferential surface of each turbine rotor disk 630 is provided with multiple turbine blade coupling slots 632 to be engaged with respective turbine blades 510 which will be described later.

The turbine blade coupling slots 632 have a fir-tree shape to firmly retain the respective turbine blades 510 so that the turbine blades 510 will not fly out of the turbine blade coupling slots 632 in a direction of rotation of the rotor 600.

The turbine blades 510 are typically coupled to the turbine rotor disk 630 in a tangential manner or an axial manner. In the present embodiment, the turbine blades 510 are configured to be coupled to the turbine rotor disk 630 in an axial manner. Therefore, according to the present embodiment, each turbine rotor disk has multiple turbine blade coupling slots 632, and the turbine blade coupling slots 632 are radially arranged along the circumferential direction of the turbine rotor disk 630.

The torque tube 620 is a torque transferring member that transfers the rotary force of the turbine rotor disk 630 to the compressor rotor disk 610. One end (hereinafter, referred to as a first end) of the torque tube 620 is fastened to a compressor rotor disk 610 located at an downstream end of the rotor in the direction of flow of the combustion gas and the other end (hereinafter referred to as a second end) of the torque tube 620 is fastened to a turbine rotor disk 630 located at an upstream end in the direction of flow of the combustion gas. Each of the first end and the second end of the torque tube 620 is provided with a protrusion, and each of the compressor rotor disk 610 and the turbine rotor disk 630 has a recess to engage with a corresponding protrusion of the protrusions. Since the protrusions of the torque tube 620 are engaged with the recesses of the compressor rotor disk 610 and the turbine rotor disk 630, relative rotation of the torque tube 620 with respect to the compressor rotor disk 610 and the turbine rotor disk 630 can be prevented.

The torque tube 620 is formed in the shape of a hollow cylinder so that the air supplied from the compressor 200 can flow through the torque tube 620 to the turbine 500.

In addition, in consideration of an operation characteristic of a gas turbine which continuously operates for a long period of time in a high temperature condition, the torque tube 620 is required to withstand high temperatures so as not to be deformed or twisted in a high temperature condition. Furthermore, it is required that the torque tube 620 be easily assembled and disassembled for easy maintenance.

The tie rod 640 is installed to extend through the multiple compressor rotor disks 610, the torque tube 620, and the multiple turbine rotor disks 630. One end (hereinafter, referred to as a first end) of the tie rod 640 is connected to an inner portion of the compressor rotor disk 610 located at the upstream end in the direction of the flow of air among the multiple compressor rotor disks 610, and the other end (hereinafter, referred to as a second end) of the tie rod 640 protrudes downstream from the turbine rotor disk 610 located at the downstream end among the multiple turbine rotor disks 630 and engages with the fixing nut 650.

The fixing nut 650 presses the turbine rotor disk 630 located at the downstream end toward the compressor 200 so that the spacing between the compressor rotor disk 610 located at the upstream end and the turbine rotor disk 630 located at the downstream end can be reduced. Thus, the multiple compressor rotor disks 610, the torque tube 620, and the multiple turbine rotor disks 630 can be compactly arranged in the axial direction of the rotor 600. Therefore, axial movement and relative rotation of the multiple compressor rotor disks 610, the torque tube 620, and the multiple turbine rotor disks 630 are prevented.

Although the present embodiment provides a configuration in which a single tie rod 640 passes through the centers of multiple compressor rotor disks 610, a torque tube 620, and multiple turbine rotor disks 630, the present disclosure is not limited thereto. The compressor 200 and the turbine 500 is provided with respective tie rods 640. Alternatively, multiple tie rods 640 are radially arranged along a circumferential direction. Further alternatively, a combination of those types can be embodied as an exemplary embodiment of the present disclosure.

The rotor 600 is rotatably supported by bearings at respective ends thereof, and one end of the rotor 600 is connected to a drive shaft of the electric generator.

In addition to the compressor blades 210 that rotate along with rotation of the rotor 600, the compressor 200 includes compressor vanes 220 retained to the inside surface of the housing 100 to guide the flow of air to be supplied to the compressor blades 210.

There are multiple compressor blades 210, and the multiple compressor blades 210 are arranged in multiple stages along the axial direction of the rotor 600. The multiple compressor blades 210 are provided at each stage of the rotor 600 and radially arranged along a direction of rotation of the rotor 600.

Each of the compressor blades 210 includes a compressor blade platform member having a flat plate shape, a compressor blade root member radially extending toward the radial center of the rotor from the compressor blade platform member, and a compressor blade airfoil member radially extending toward the radial centrifugal side of the rotor 600 from the compressor blade platform member.

The compressor blade platform member of one compressor blade is in contact with the compressor blade platform member of the next compressor blade. Therefore, the compressor blade platform members function to space adjacent compressor blade airfoil members from each other.

The compressor blade root members are inserted into the respective compressor blade coupling slots in an axial direction of the rotor 600 as described above.

The compressor blade root members have a fir-tree shape so as to be correspondingly engaged with the compressor blade coupling slots.

Although the present embodiment provides a configuration in which the compressor blade root members and the compressor blade coupling slots have a fir-tree shape, the present disclosure is not limited thereto. That is, the compressor blade root members and the compressor blade coupling slots have a dove tail shape. Alternatively, the compressor blades 210 are retained to the compressor rotor disk 610 by means of different types of coupling tools such as a key or a bolt.

As to the compressor blade root member and the compressor blade coupling slot, in order for the compressor blade root member and the compressor blade coupling slot to be easily engaged with each other, the compressor blade coupling slot is slightly larger than the compressor blade root member. In the engaged state, there is a clearance between the surface of the compressor blade root member and the surface of the compressor blade coupling slot.

Although not illustrated, the compressor blade root member is retained in the compressor blade coupling slot by a pin which prevents the compressor blade root member from being removed from the compressor blade coupling slot in an axial direction.

The compressor blade airfoil member has an optimum shape according to the specifications of a given type of gas turbine. The compressor blade airfoil member include a compressor blade airfoil member leading edge which is located at an upstream side in the direction of flow of air and a compressor blade airfoil member trailing edge at a downstream side so that the air flows toward the leading edge and exits the trailing edge.

There are more than one compressor vanes 220, and the more than one compressor vanes 220 are arranged in multiple stages arranged in an axial direction of the rotor 600. The compressor vanes 220 and the compressor blades 210 are alternately arranged in the direction of flow of air.

The compressor vanes 220 in each stage are radially arranged along a direction of rotation of the rotor 600.

Each of the compressor vanes 220 includes a compressor vane platform member having an annular shape formed along the direction of rotation of the rotor 600 and a compressor vane airfoil member extending from the compressor vane platform member in a radial direction of the rotor 600.

The compressor vane platform member includes a root-side compressor vane platform member disposed at the root of the compressor vane airfoil member and fastened to the compressor housing 110 and a tip-side compressor vane platform member disposed at the tip of the compressor vane airfoil member and disposed to face the rotor 600.

Here, although the present embodiment provides a configuration including the root-side compressor vane platform member and the tip-side compressor vane platform member to support not only a root portion of the compressor vane airfoil member but also a tip portion of the compressor vane airfoil member to more stably support the compressor vane airfoil member, the present disclosure is not limited thereto. That is, the compressor vane platform member includes only the root-side compressor vane platform member to support only the root portion of the compressor vane airfoil member.

Each of the compressor vanes 220 further include a compressor vane root member for fastening the root-side compressor vane platform member to the compressor housing 110.

The compressor vane airfoil member has an optimum shape according to the specifications of a given type of gas turbine. The compressor vane airfoil member includes a compressor vane airfoil member leading edge which is located at an upstream side in the direction of flow of air and a compressor vane airfoil member trailing edge at a downstream side so that the air flows toward the leading edge and exits the trailing edge.

The combustor 400 mixes fuel with the compressed air supplied from the compressor 200 and burns the fuel and air mixture to produce a high-pressure hot combustion gas having high energy and heats the combustion gas to heat-resisting temperatures of the combustor 400 and the turbine 500 through an isobaric combustion process.

Specifically, there are more than one combustors 400, and the combustors 400 are arranged in the combustor housing 120 in a direction of rotation of the rotor 600.

Each of the combustors 400 includes a liner into which the compressed air is introduced from the compressor 200, a burner which ejects fuel toward the compressed air introduced into the liner and burns the fuel and air mixture to produce a combustion gas, and a transition piece that guides the combustion gas to the turbine 500.

The liner include a flame tube serving as a combustion chamber and a flow sleeve surrounding the flame tube to form an annulus space therein.

The burner includes a fuel spray nozzle disposed at a front stage of the liner to spray fuel to the air introduced into the combustion chamber and an ignition plug provided in the wall of the liner to ignite the fuel and air mixture in the combustion chamber.

The outer wall of the transition piece is cooled by cooling air (hereinafter, referred to as coolant) supplied from the compressor 200 so that the transition piece is not damaged by the high temperature heat of the combustion gas.

The transition piece is provided with cooling holes through which air is sprayed inward. This sprayed air introduced through the cooling holes cools the body of the transition piece.

The air that is used to cool the transition piece flows into the annulus space inside the flow sleeve. In addition, external air as coolant is introduced into the annulus space through cooling holes formed in the flow sleeve and thus the coolant impinges against the surface of the outer wall of the liner.

Although not illustrated, a deswirler serving as a guide vane is provided between the compressor 200 and the combustor 400 to control the inlet angle of air that is introduced into the combustor 400 from the compressor 200 such that the actual inlet angle matches the designed inlet angle.

The turbine 500 has the substantially same structure as the compressor 200.

That is, the turbine 500 includes turbine blades 510 rotating along with rotation of the rotor 600 and turbine vanes 520 fixed to the housing 100 to guide the flow of air to be supplied to the turbine blades 510.

There are more than one turbine blades 510, and the more than one turbine blades 510 are arranged in multiple stages along the axial direction of the rotor 600. The more than one turbine blades 510 are provided in each stage of the rotor 600 and radially arranged along a circumferential direction of the rotor 600.

Each of the turbine blades 510 includes a turbine blade platform member 512 having a flat plate shape, a turbine blade root member 514 radially extending toward the radial center of the rotor 600 from the turbine blade platform member 512, and a turbine blade airfoil member 516 radially extending toward the radial centrifugal side of the rotor 600 from the turbine blade platform member 512.

One turbine blade platform member 512 is in contact with the next compressor blade platform member 512. Thus, the turbine blade platform members 512 function to space adjacent compressor blade airfoil members 516 from each other.

The turbine blade root members 514 are of so-called axial type so that they are inserted into the respective turbine blade coupling slots 632 in an axial direction of the rotor 600 as described above.

The turbine blade root members 514 have a fir-tree shape corresponding to the shape of the turbine blade coupling slots 632.

Although the present embodiment provides a configuration in which the turbine blade root members and the turbine blade coupling slots have a fir-tree shape, the present disclosure is not limited thereto. That is, the turbine blade root members and the turbine blade coupling slots have a dove tail shape. Alternatively, the turbine blades 510 are retained to the turbine rotor disk 630 by means of a different type of coupling tool such as key or bolt.

As to the turbine blade root members 514 and the turbine blade coupling slots 632, in order for the turbine blade root members 514 and the turbine blade coupling slots 632 to be easily fastened, the turbine blade coupling slots 632 are formed to be slightly larger than the turbine blade root members 514. In the engaged state, there is a clearance between the surface of the turbine blade root member 514 and the surface of the turbine blade coupling slot 632.

Although not illustrated, a pin is used to retain the turbine blade root member 514 to the turbine blade coupling slot 632 to prevent the turbine blade root member 514 from being removed from the turbine blade coupling slot 632 in the axial direction.

The turbine blade airfoil member 516 has an optimum shape according to the specifications of a given type of gas turbine. The turbine blade airfoil member includes a turbine blade airfoil member leading edge which is located at an upstream side in the direction of flow of air and a turbine blade airfoil member trailing edge which is located at a downstream side so that the air flows toward the leading edge and exits the trailing edge.

There are more than one turbine vanes 520, and the more than one turbine vanes 520 are arranged in multiple stages in the axial direction of the rotor 600. The turbine vanes 520 and the turbine blades 510 are alternately arranged in the direction of flow of air.

The turbine vanes 520 in each stage are radially arranged along a circumferential direction of the rotor 600.

Each of the turbine vanes 520 includes a turbine vane platform member having an annular shape formed along the direction of rotation of the rotor 600 and a turbine vane airfoil member extending from the turbine vane platform member in a radial direction of the rotor 600.

The turbine vane platform member includes a root-side turbine vane platform member disposed at a root of the turbine vane airfoil member and fastened to the turbine housing 130 and a tip-side turbine vane platform member disposed at a tip of the turbine vane airfoil member and disposed to face the rotor 600.

Here, although the present embodiment provides a configuration including both the root-side turbine vane platform member and the tip-side turbine vane platform member to support not only the root portion of the turbine vane airfoil member but also the tip portion of the turbine vane airfoil member to more stably support the turbine vane airfoil member, the present disclosure is not limited thereto. That is, the turbine vane platform member includes only the root-side turbine vane platform member to support only the root portion of the turbine vane airfoil member.

Each of the turbine vanes 520 further include a turbine vane root member for fastening the root-side turbine vane platform member to the turbine housing 130.

The turbine vane airfoil member has an optimum shape according to the specifications of a given type of gas turbine. The turbine vane airfoil member includes a turbine vane airfoil member leading edge which is positioned at an upstream side in the direction of flow of the combustion gas and a turbine vane airfoil member trailing edge which is positioned at a downstream side so that the combustion gas flows toward the leading edge and exits the trailing edge.

Unlike the compressor 200, the turbine 500 needs to be equipped with a cooling unit which prevents the turbine 500 from being damaged or deteriorated by heat of high temperatures because the turbine 500 comes into direct contact with the hot high-pressure combustion gas.

Therefore, the gas turbine according to the present embodiment further includes a cooling passage through which the compressed air can be bleed from a portion of the compressor 200 so as to be supplied to the turbine 500.

The cooling passage is an external passage that externally extends to an inside portion of the housing 100 or an internal passage that extends through the rotor 600. Alternatively, the cooling passage is a combination of the external passage and the internal passage.

The cooling passage is connected to a turbine blade cooling channel 518 formed in the turbine blade 510 so that the turbine blade 510 can be cooled by cooling air.

The turbine blade cooling channel 518 is formed to communicate with turbine blade film cooling holes formed in the surface of the turbine blade 510 so that the cooing air can be supplied to the surface of the turbine blade 510 via the cooling channel 518 and the turbine blade film cooling holes. Therefore, the turbine blade 510 can be film-cooled by the cooling air.

The turbine vane 520 is similarly structured to the turbine blade 510, so that the turbine vane 520 can also be cooled by the cooling air supplied through the cooling passage.

Turbine 500 needs to have a clearance between the tip of each turbine blade 510 and the inside surface of the turbine housing 130 so that the turbine blades 510 can smoothly rotate without friction with the inside surface of the turbine housing 130.

As the clearance increases, it is advantageous in that the turbine blades 510 can be more surely free of interference of the turbine housing 130. For the combustion gas discharged from the combustor 400, there are two flows: a main passage flow passing along the turbine blades 510 and a leakage flow passing through the clearance between the tip of the turbine blade 510 and the inside surface of the turbine housing 130. As the height of the clearance increases, the leakage flow increases and the performance of the gas turbine deteriorates. However, the increased height of the clearance is advantageous in that the interference between the turbine blade 510 and the turbine housing 130, which mainly occurs due to deformation of the turbine housing 130 and the turbine blade 510 due to the heat of hot combustion gas, is reduced and thus the damage of the turbine blade 510 and the housing can be prevented. Meanwhile, as the height of the clearance decreases, the leakage flow decreases, resulting in improvement in efficiency of a gas turbine. This also comes with a drawback that the turbine blade 510 and the turbine housing 130 are likely to be damaged because there is a risk that the interference between the turbine blade 510 and the turbine housing 130 occurs.

Therefore, according to the present embodiment, the gas turbine further includes a sealing unit to secure an optimum clearance height while reducing the deterioration in performance of the gas turbine and preventing the interference between the turbine blade 510 and the turbine housing 130 and its associated damage.

The turbine 500 further includes a sealing unit to prevent a leakage flow between the turbine vane 520 and the rotor 600.

The gas turbine structured as described above operates in a manner described below. First, air is introduced into the housing 100 and compressed by the compressor 200. The resulting compressed air is mixed with fuel and burned by the combustor 400, generating combustion gas which is in turn introduced into the turbine 500. In the turbine 500, the combustion gas passes the turbine blades 510 to rotate the rotor 600 which in turn drives the compressor 200 and the electric generator. The combustion gas used to rotate the rotor 600 is then discharged into the atmosphere via the diffuser. That is, a part of the mechanical energy generated by the turbine 500 is used for air compression by the compressor 200 and the other part is used for electricity generation by the electric generator.

As to the turbine blade airfoil member 516, the center of gravity C, C' is located outside the body of the turbine blade airfoil member 516 in terms of a direction of rotation of the turbine blade airfoil member due to the turbine blade cooling passage 518 formed therein. For this reason, there is a possibility that the turbine blade 510 exhibits abnormal behaviors.

Taking this into account, the turbine blade 510 according to the present embodiment includes a coating layer 515 formed on the surface of the turbine blade airfoil member 516, in which the coating layer locally differs in weight by a predetermined amount in weight. The coating layer 515 is formed such that the center of gravity C, C' is located at a position within the body of the turbine blade airfoil member 516 in terms of the direction of rotation of the turbine blade airfoil member 516 and preferably at a position on the mean camber line MCL of the turbine blade air foil member 516. Thus, it is possible to prevent abnormal behaviors of the turbine blade 510.

Specifically, a pre-alignment center of gravity C which is the center of gravity C of the turbine blade airfoil member 516 before the coating layer 515 is formed is located at a point on one side (referred to as a first side S1 herein or a suction side) of the mean camber line MCL of the turbine blade airfoil member 516 or on the opposite side (referred to as a second side S2 herein or a pressure side) of the mean camber line MCL of the turbine blade airfoil member 516. The coating layer 515 is formed to include a first coating layer 515*a* on the first side S1 and a second coating layer 515*b* on the second side S2, in which the second coating layer 515*b* is formed to be thicker, by a predetermined amount in thickness, than the first coating layer 515*a* (i.e., the thickness of the second coating layer 515*b* is greater than the thickness of the first coating layer 515*a* by the predetermined amount in thickness).

In this case, the first coating layer 515*a* and the second coating layer 151*b* are made of same-density materials which are exemplarily embodied with the same material or otherwise different materials which nonetheless have same density. Although the first coating layer 515*a* and the second coating layer 515*b* are made of the same material, the first coating layer 515*a* and the second coating layer 515*b* are differently formed in thickness thereof.

Although the first coating layer 515*a* and the second coating layer 515*b* differ in thickness, the first coating layer 515*a* and the second coating layer 151*b* are flush (i.e., level) with each other at the boundary between the first side S1 and the second side S2 to prevent flow separation. That is, the thickness of the first coating layer 515*a* gradually increases or decreases toward the boundary between the first side S1 and the second side S2 so as to converge to a predetermined thickness of the coating layer formed at the boundary between the first side S1 and the second side S2. Similarly, the thickness of the second coating layer 515*b* gradually increases or decreases toward the boundary between the first side S1 and the second side S2 so as to converge to the predetermined thickness of the coating layer formed at the boundary between the first side S1 and the second side S2.

In the turbine blade 510, the weight of the second coating layer 515*b* is greater than the weight of the first coating layer 515*a*. Therefore, the center of gravity of the turbine blade 510 is moved from the pre-alignment center of gravity C to a post-alignment center of gravity C', which means the center of gravity after the coating layer is formed for adjustment of the center of gravity, which is determined by the total weight of the turbine blade 510 including the coating layer 515. That is, a manufacturing process related to the coating layer results in moving the center of gravity of turbine blade 510 from C to C'. The center of gravity of turbine blade 510 is required to be adjusted so that the post-alignment center of gravity is located on a point along the mean camber line MCL of the turbine blade airfoil member, thereby preventing abnormal behaviors of the turbine blade 510 where the abnormal behaviors may be caused by a failure of alignment in the center of gravity of a turbine blade out of the mean camber line MCL of the turbine blade airfoil member.

When the first coating layer 515*a* and the second coating layer 515*b* are made of the same material, this case is advantageous over a case where the first coating layer 515*a* and the second coating layer 515*b* are made of different materials in terms of ease of fabrication and reduction in production cost.

In addition, when the first coating layer 515*a* and the second coating layer 515*b* are formed of the same material, it is possible to prevent cracks from occurring at the boundary between the first coating layer 515*a* and the second coating layer 515*b* due to the difference in material characteristics.

The turbine blade 510 in the present embodiment can be formed such that the post-alignment center of gravity C' of the turbine blade 510 is located specifically at a middle point of the mean camber line MCL. This structure can more effectively prevent abnormal behaviors of the turbine blade than any other cases where the center of gravity is located at other points than the midpoint on the mean camber line.

In another example, it happens that the pre-alignment center of gravity C is located at a point on one side (referred to as a third side S3 herein or a leading edge side) with respect to a normal line NL passing the middle point of the mean camber line MCL or on the opposite side (referred to as a fourth side S4 herein or a trailing edge side). In this case, the coating layer 515 is formed to include a third coating layer 515*c* located on the third side S3 and a fourth coating layer 515*d* located on the fourth side S4, in which the fourth coating layer 515*d* is thicker than the third coating layer 515*c*.

The third coating layer 515*c* and the fourth coating layer 151*b* are made of same density materials which will be preferably the same material.

Here, the third coating layer 515*c* and the fourth coating layer 515*d* are not additional layers formed on or under the first coating layer 515*a* and the second coating layer 515*b*. That is, the coating layer 515 is divided into the first coating layer 515*a* and the second coating layer 515*b* by the mean camber line MCL, or into the third coating layer 515*c* and the fourth coating layer 515*d* by the normal line NL. Therefore, a portion of the coating layer 515 is either the first coating layer 515*a* or the second coating layer 515*b*, or either the third coating layer 515*c* or the fourth coating layer 515*d*.

Although the third coating layer 515*c* and the fourth coating layer 151*d* differ in thickness, the third coating layer 515*c* and the fourth coating layer 151*d* are flush (i.e., level) with each other at least at the boundary between the third side S3 and the fourth side S4 to prevent flow separation. That is, the thickness of the third coating layer 515*c* gradually increases or decreases toward the boundary between the third side S3 and the fourth side S4 so as to converge toward the thickness of the coating layer formed at the boundary between the third side S3 and the fourth side S4. Similarly, the thickness of the fourth coating layer 515*d* gradually increases or decreases toward the boundary between the third side S3 and the fourth side S4 so as to converge toward the thickness of the coating layer at the boundary between the third side S3 and the fourth side S4.

In the turbine blade 510, since the weight of the fourth coating layer 515*d* is greater by a predetermined amount in weight than the weight of the third coating layer 515*c*, the post-alignment center of gravity C' is located at the middle point of the mean camber line MCL. Therefore, it is possible to effectively prevent abnormal behaviors of the turbine blade 510.

When the third coating layer 515*c* and the fourth coating layer 515*d* are made of the same material, this case is advantageous over a case where the third coating layer 515*c* and the fourth coating layer 515*d* are made of different materials in terms of ease of fabrication and reduction in production cost.

In addition, when the third coating layer 515*c* and the fourth coating layer 515*d* are made of the same material, it is possible to prevent cracks from occurring at the boundary between the third coating layer 515*c* and the fourth coating layer 515*d* due to the difference in material characteristics.

In the embodiment described above, in order to implement the configuration in which the weight of the second coating layer 151*b* is greater than that of the first coating layer 515*a*, the second coating layer 151*b* is formed to be thicker than the first coating layer 515*a*. However, the present disclosure is not limited thereto. There are also other approaches to implement the configuration.

For example, although not illustrated in the drawings, the second coating layer 515*b* is formed of a high density material compared to the first coating layer 515*a* to obtain the configuration in which the second coating layer 515*b* is heavier than the first coating layer 515*a*.

The operation and effect of this case is the same as those of the former embodiment.

However, in this case, the first coating layer 515*a* and the second coating layer 151*b* have an equal thickness. Therefore, it is easier to control the thickness of the coating layer 515, thereby reducing cost for management and control of the thickness of the coating layer 515. In addition, exemplary embodiments obtain advantageous effect to prevent a likelihood that a thickness change in the coating layer 515 negatively affects the fluid flow.

Similarly, in a case where the third coating layer 515*c* and the fourth coating layer 515*d* differ in density by a predetermined amount, the coating layer 515 is formed to have a uniform thickness.

That is, in the embodiment described above, the fourth coating layer 515*d* is formed to be thicker by a predetermined amount than the third coating layer 515*c* to implement the configuration in which the weight of the fourth coating layer 515*d* is greater by a predetermined amount in weight than the weight of the third coating layer 515*c*. However, the present disclosure is not limited thereto. Although not illustrated, the fourth coating layer 515*d* is formed to be heavier than the third coating layer 515*c* in such a manner that the fourth coating layer 515*d* is formed of a high density material compared to the third coating layer 515*c*.

The operation and effect of this case are substantially the same as those of the former embodiment.

However, in this case, the third coating layer 515*c* and the fourth coating layer 151*b* can be formed to have an equal thickness. Therefore, it is easier to control the thickness of the coating layer 515, thereby reducing cost for management and control of the thickness of the coating layer 515. In addition, it is possible to prevent a likelihood that a thickness change in the coating layer 515 negatively affects the fluid flow.

Meanwhile, in the embodiment described above, the center of gravity C, C' is adjusted with the coating layer 515. However, the method of adjusting the center of gravity is not limited thereto. That is, as shown in FIGS. 4 and 5, the center of gravity C, C' can also be adjusted with a tip wall 517 formed at the tip of the turbine blade airfoil member 516.

The tip wall 517 extends radially outwards from the tip of the turbine blade airfoil member 516 by a predetermined height to adjust the natural frequency of the turbine blade 510. With the tip wall 517 varying in parameters according to locations in the turbine blade airfoil member 516, it is possible to adjust the center of gravity C, C' of the turbine blade 510 such that the center C, C' is located within the body (preferably, on the mean chamber line MCL) of the turbine blade airfoil member 516 in terms of the direction of rotation of the turbine blade airfoil member 516.

More specifically, a pre-alignment center of gravity C which is the center of gravity before the tip wall 517 is formed is located at a point on one side (referred to as a first side S1 or a pressure side) with respect to the mean camber line MCL or on the opposite side (referred to as a second side S2 or a suction side). In this case, for adjustment of the center of gravity of the turbine blade, the tip wall 517 is formed to include a first tip wall 517*a* disposed on the first side S1 and a second tip wall 517*b* disposed on the second side S2, in which the height of the second tip wall 517*b* is larger by a predetermined amount than the height of the first tip wall 517*a*.

The first tip wall 517*a* and the second tip wall 517*b* are made of same-density materials which preferably will be the same material.

In this turbine blade 510, the weight of the second tip wall 517*b* is greater by a predetermined amount in weight than the weight of the first tip wall 517*a*. Therefore, the pre-alignment center of gravity C which is located on the first side or the second side is moved to a post-alignment center of gravity C', which means the center of gravity after the weight of the tip wall 517 is reflected and is located a position on the mean camber line (MCL). Therefore, abnormal behaviors of the turbine blade 510 can be prevented.

When the first tip wall 517*a* and the second tip wall 517*b* are made of the same material, this case is advantageous over a case where the first tip wall 517*a* and the second tip wall 517*b* are made of different materials in terms of ease of fabrication and reduction in production cost.

In addition, when the first tip wall 517*a* and the second tip wall 517*b* are made of the same material, it is possible to prevent cracks from occurring at the boundary of the first tip wall 517*a* and the second tip wall 517*b* due to the difference in material characteristics.

In another example, the pre-alignment center of gravity C is located at a point on one side (a third side S3 or a trailing edge side) with respect to a normal line NL passing a middle point of the mean camber line MCL or on the opposite side (a fourth side S4 or a leading edge side). In this case, the tip wall 517 is formed to include a third tip wall 517*c* disposed on the third side S3 and a fourth tip wall 517*d* disposed on the fourth side S4, in which the height of the fourth tip wall 517*d* is larger than the third tip wall 517*c*.

The third tip wall 517*c* and the fourth tip wall 517*b* are made of same-density materials which will be preferably the same material.

Here, the third tip wall 517*c* and the fourth tip wall 517*d* are not tip walls added to the first tip wall 517*a* and the second tip wall 517*b*. That is, the coating layer 517 is divided into the first tip wall 517*a* and the second tip wall 517*b* by the mean camber line MCL or into the third tip wall 517*c* and fourth tip wall 517*d* by the normal line NL. Therefore, a portion of the tip wall 517 is either the first tip wall 517*a* or the second tip wall 517*b*, or either the third tip wall 517*c* or the fourth tip wall 517*d*.

In the turbine blade 510, since the weight of the fourth tip wall 517*d* is greater by a predetermined amount in weight than the weight of the third tip wall 517*c*, the pre-alignment center of gravity C is moved to the post-alignment center of gravity C' which is located at the middle point of the mean camber line MCL. Therefore, it is possible to effectively prevent abnormal behaviors of the turbine blade 510.

When the third tip wall 517*c* and the fourth tip wall 517*d* are made of the same material, this case is advantageous over a case where the third tip wall 517*c* and the fourth tip wall 517*d* are made of different materials in terms of ease of fabrication and reduction in production cost.

In addition, when the third tip wall 517*c* and the fourth tip wall 517*d* are made of the same material, it is possible to prevent cracks from occurring at the boundary between the third tip wall 517*c* and the fourth tip wall 517*d* due to the difference in material characteristics.

Alternatively, although not illustrated in the drawings, the second tip wall 517*b* is made of a high density material compared to the first tip wall 517*a* to obtain the configuration in which the second tip wall 517*b* is heavier than the first tip wall 517*a*.

The operation and effect of this case are substantially the same as those of the former embodiment.

However, in this case, the first tip wall 517*a* and the second tip wall 517*b* are formed to have an equal height. Therefore, it is easier to control the height of the tip wall 517, thereby reducing cost for management and control of the height of the tip wall 517. In addition, it is possible to prevent a likelihood that a height change in the tip wall 517 negatively effects the fluid flow.

Similarly, in a case where the third tip wall 517*c* and the fourth tip wall 517*d* differ in density, the tip wall 517 is formed to have a uniform height.

Although not illustrated in the drawings, the configuration in which the fourth tip wall 517*d* is heavier than the third tip wall 517*c* can be implemented by forming the fourth tip wall 517*d* with a higher density material than the material of the third tip wall 517*c*.

The operation and effect of this case are substantially the same as those of the former embodiment.

However, in this case, the third tip wall 517*c* and the forth tip wall 517*d* can be formed to have an equal height. Therefore, it is easier to control the height of the tip wall 517, thereby reducing cost for management and control of the height of the tip wall 517. In addition, it is possible to prevent a likelihood that a height change in the tip wall 517 negatively affects the fluid flow.

In addition, as to the compressor blade 210, the coating layer formed on the surface of the compressor blade airfoil member can be adjusted in a similar manner to the coating layer formed on the turbine blade 510. That is, the thickness or material density of the coating layer formed on the surface of the compressor blade airfoil member varies according to locations, or the height or material density of the tip wall formed at the tip of the compressor blade airfoil member varies according to locations to make the center of gravity of the compressor blade airfoil member be located at a predetermined position. In this way, the present disclosure obtains advantageous effect to prevent abnormal behaviors of the compressor blades 210.

As exemplary embodiments of the present disclosure have been described for illustrative purposes, it will be appreciated by those skilled in the art that the embodiments of the present disclosure described above are merely illustrative and that various modifications and equivalent embodiments are possible without departing from the scope and spirit of the claimed invention. Specific terms used in this disclosure and drawings are used for illustrative purposes and not to be considered as limitations of the present disclosure. Therefore, it will be appreciated that the present disclosure is not limited to the form set forth in the foregoing description. Accordingly, the scope of technical protection of the claimed invention is determined by the technical idea of the appended claims. One of ordinary skill would understand that the present disclosure covers all modifications, equivalents, and alternatives falling within the spirit and the scope of the claimed invention as defined by the appended claims.

What is claimed is:

1. A gas turbine comprising:

a housing;

a rotor rotatably provided in the housing and configured to transfer a rotary force to a compressor, the compressor configured to receive the rotary force from the rotor, and compress air using the rotary force;

a combustor configured to mix a fuel with the compressed air supplied by the compressor, and ignite the mixture of the fuel and the air to generate a combustion gas; and a turbine configured to receive the rotary force caused by the combustion gas generated by the combustor, and rotate the rotor by using the received rotary force, the turbine including a turbine blade rotating along with rotation of the rotor, wherein the turbine blade includes:

a turbine blade airfoil member configured to come into contact with the combustion gas, and a coating layer formed on a surface of the turbine blade airfoil member, the coating layer being differently formed depending on locations of the turbine blade airfoil member, wherein the turbine blade airfoil member has a post-alignment center of gravity and is formed such that post-alignment center of gravity is located on a point along a mean camber line of the turbine blade airfoil member.

2. The gas turbine according to claim 1, wherein the turbine blade airfoil member has a pre-alignment center of gravity that is located at a point on either of a first side and second side of the mean camber line before the coating layer is formed, wherein the first side of the mean camber line indicates a side located above the mean camber line, and the second side indicates a side located below the mean camber line, and wherein a second coating layer disposed on the second side is formed to have a greater weight by a predetermined amount than a first coating layer disposed on the first side so that the post-alignment center of gravity is located within the turbine blade airfoil member.

3. The gas turbine according to claim 2, wherein the second coating layer has a larger thickness than the first coating layer, the first coating layer and the second coating layer are made of a same material, a thickness of the first coating layer gradually increases or decreases toward a boundary between the first side and the second side from a periphery of the first coating layer so as to converge toward a thickness of the second coating layer formed at the boundary between the first side and the second side, and the thickness of the second coating layer gradually increases or decreases toward the boundary between the first side and the second side from a periphery of the second coating layer so as to converge toward the thickness of the first coating layer formed at the boundary, so that a surface of the first coating layer and a surface of the second coating layer are flush with each other at the boundary between the first side and the second side.

4. The gas turbine according to claim 2, wherein the second coating layer is made of a material having a higher density by a predetermined amount than a material of the first coating layer, and the first coating layer and the second coating layer have an equal thickness.

5. The gas turbine according to claim 1, wherein the turbine blade airfoil member has a pre-alignment center of gravity that is located outside the turbine blade airfoil member in terms of a rotation direction.

6. The gas turbine according to claim 5, wherein the pre-alignment center of gravity of the turbine blade airfoil member is located at a point on either of a third side and a fourth side of a normal line passing a middle point of the mean camber line before the coating layer is formed, wherein the third side of the normal line indicates a side located above the normal line passing a middle point of the mean camber line, and the second side indicates a side located below the normal line passing a middle point of the mean camber line, and wherein a fourth coating layer disposed on the fourth side is formed to have a greater weight by a predetermined amount than a third coating layer disposed on the third side so that the post-alignment center of gravity is located within the turbine blade airfoil member.

7. The gas turbine according to claim 6, wherein the fourth coating layer has a larger thickness by a predetermined amount than the third coating layer, the third coating layer and the fourth coating layer are made of a same material, a thickness of the third coating layer gradually increases or decreases toward a boundary between the third side and the fourth side from a periphery of the third coating layer so as to converge toward a thickness of the fourth coating layer formed at the boundary between the third side and the fourth side, and the thickness of the fourth coating layer gradually increases or decreases toward the boundary between the third side and the fourth side from a periphery of the fourth coating layer so as to converge toward the thickness of the third coating layer formed at the boundary between the third side and the fourth side, so that a surface of the third coating layer and a surface of the fourth coating layer are flush with each other at the boundary between the third side and the fourth side.

8. The gas turbine according to claim 6, wherein the fourth coating layer is made of a material having a higher density by a predetermined amount than a material of the third coating layer, and the third coating layer and the fourth coating layer have an equal thickness.

9. A gas turbine comprising:

a housing;

a rotor rotatably provided in the housing; and a blade configured to rotate along with rotation of the rotor, wherein an airfoil member of the blade includes a coating layer formed on a surface of the airfoil member of the blade, and the coating layer locally differs in either one or both of a thickness and a density, and wherein the airfoil member has a post-alignment center of gravity and is formed such that post-alignment center of gravity is located on a point along a mean camber line of the turbine blade airfoil member.

* * * * *